United States Patent [19]

Olsen et al.

[11] 4,216,906

[45] Aug. 12, 1980

[54] METHOD OF MAKING HIGH VELOCITY LIQUID JET

[75] Inventors: John H. Olsen, Vashon Island; George H. Hurlburt, Kent; Louis E. Kapcsandy, Mercer Island, all of Wash.

[73] Assignee: Flow Research, Inc., Kent, Wash.

[21] Appl. No.: 697,949

[22] Filed: Jun. 21, 1976

[51] Int. Cl.[2] ..... B05B 1/10

[52] U.S. Cl. ..... 239/11; 83/177; 210/38 R; 239/591

[58] Field of Search ..... 239/1, 11, 591; 210/37 A, 37 R, 38 R, 38 A; 83/177; 175/65

[56] References Cited

U.S. PATENT DOCUMENTS

| | | | |
|---|---|---|---|
| 3,756,106 | 9/1973 | Chadwick et al. | 83/177 |
| 3,877,334 | 4/1975 | Gerber | 83/177 X |
| 3,928,192 | 12/1975 | Katzakian, Jr. et al. | 210/37 A X |
| 3,985,648 | 10/1976 | Casolo | 210/37 R X |

*Primary Examiner*—John P. Silverstrim
*Assistant Examiner*—Michael Mar
*Attorney, Agent, or Firm*—Hughes & Barnard

[57] ABSTRACT

Water at a very high pressure (e.g. fifty thousand psi) is directed through a nozzle orifice to produce a coherent high velocity water jet particularly adapted for cutting. Prior to pressurizing the water and directing it through the nozzle, the water is treated to remove dissolved solids, desirably to an extremely low level to provide very pure water (e.g. where the total dissolved solids are as little as ten parts per million or lower). This is done by directing the water through several ion exchange reactions to precipitate the solids which are then removed by filtering. The operating life of the nozzle is greatly extended by this process.

25 Claims, 4 Drawing Figures

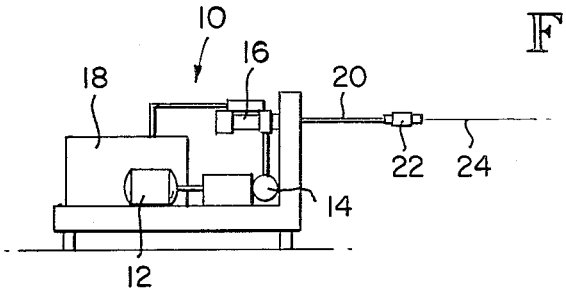
FIG. 1
FIG. 2
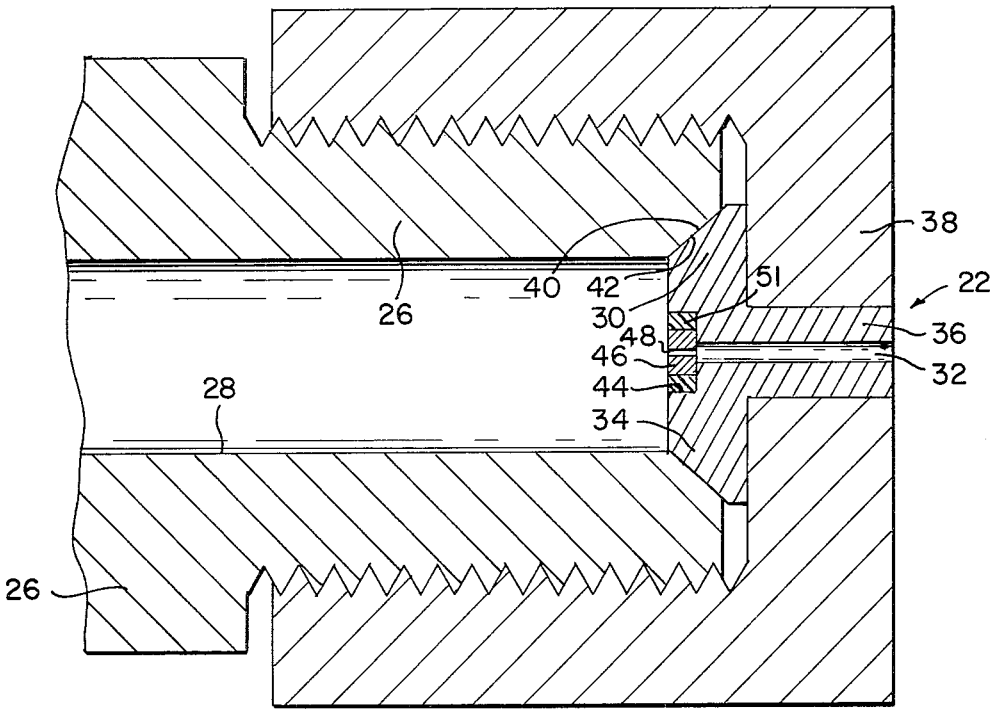
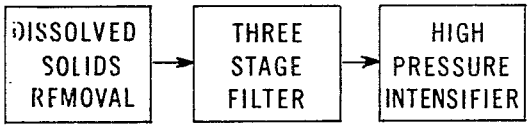
FIG. 3
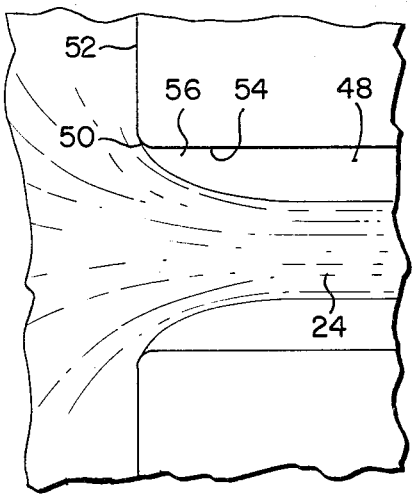
FIG. 4

METHOD OF MAKING HIGH VELOCITY LIQUID JET

BACKGROUND OF THE INVENTION

1. Field of the Invetion

The present invention relates to a method of producing a very high velocity water jet, such as that used in cutting materials, and more particularly to a method of producing a water jet in a manner to increase the operating life time of a nozzle during which it is able to produce a coherent water jet.

2. Brief Description of the Prior Art

It has long been known that a high velocity water jet can be used to cut through a variety of materials. For example, U.S. Pat. No. 2,985,050, Schwacha, discloses a method of providing a very high velocity water jet (e.g. four thousand feet per second) to cut through even very hard materials, such as metal alloys. U.S. Pat. No. 3,532,014, Franz, discloses a similar method where a high velocity water jet (with a velocity between approximately twelve hundred and four thousand feet per second) is used to cut through soft material.

It has long been recognized that if the liquid jet is formed as a very coherent stream (i.e. with very little dispersion), the cutting capability of the jet is substantially enhanced. Thus, there have been various attempts to improve the coherency of a high velocity water jet. One approach is to attempt to improve the flow by means of particular nozzle configurations. Two such examples of this approach are shown in U.S. Pat. No. 3,750,961, Franz, and U.S. Pat. No. 3,756,106, Chadwick et al, each of which provides a nozzle having a convergent passageway leading to the nozzle discharge opening.

Another prior art approach to improving the coherency of a high velocity liquid jet is disclosed in U.S. Pat. No. 3,524,367, Franz. The method disclosed in this patent involves dissolving long chain polymers in the working fluid (e.g. water) and then discharging the fluid through an orifice at very high velocity. It is stated in the patent that the liquid then exhibits a certain apparent viscosity at the very high shear rates encountered when the water with the polymer dissolved therein is discharged through a nozzle, which allegedly accounts for the improved coherency of the jet stream.

Another consideration in providing a high quality liquid jet is the effect of the deterioration of the operating components of the apparatus. Such apparatus comprises a high pressure intensifier to pressurize the working fluid in a chamber to a very high level (e.g. to as high as fifty thousand to one hundred thousand psi or higher), and a very small nozzle orifice (e.g. 0.001 to 0.040 inch) through which the working fluid is discharged to form the liquid jet. Quite commonly, the material which makes up the orifice is a very hard material, such as corundum crystal, formed within very close tolerances in a configuration with a minimum of irregularities which might disturb the flow. This is to minimize turbulence in the water passing from the nozzle orifice, since such turbulence would have the effect of causing unwanted dispersion in the jet stream. In the area closely adjacent to the nozzle orifice, the working fluid (e.g. water) accelerates at a very rapid rate to exit from the nozzle orifice as a very small stream travelling at a velocity as high as three thousand feet per second or higher. The area of the orifice is very critical in the formation of a coherent jet.

However, even when the orifice is made of a very hard material formed within very closed tolerances, over a period of time of possibly ten to twenty hours, the performance of the nozzle tends to deteriorate, which is evidenced by a quite noticeable dispersion of the water jet. This in turn requires the shutting down of the apparatus so that the crystal which forms the nozzle orifice can be replaced.

SUMMARY OF THE INVENTION

The present invention is predicated upon the discovery that if prior to discharging the water as a high velocity jet the working fluid (commonly water) is treated to remove even very small amounts (in the order of several parts per million) of material dissolved in the liquid, the longevity of the nozzle which forms the jet is substantially prolonged. It is believed that such materials tend to precipitate from the liquid at the high temperatures (in the order of 140° F. up and possibly 400° F.) and relatively low pressures that exist at the edge of the orifice.

Prior to the discovery of the present invention, it had been recognized in the prior art that the cleanliness of the water used as the working fluid for the high velocity jet is an important factor. Thus, water of a relatively high purity has been commonly used, and this water is filtered to remove suspended particles even as small as twenty millionths of an inch in diameter. However, with the very high pressures and velocities involved, even with the selection of high quality crystal nozzle components, it is quite often difficult to maintain the quality of such nozzle components much beyond ten to twenty hours of use. It has been believed that the eroding effect of the high velocity water and/or of very small particles suspended in the water would degrade the surface of the nozzle by breaking away small particles from the nozzle orifice.

In accordance with the present invention, it has been found that quite minute quantities of dissolved material that would normally be expected to remain totally dissolved in the water can also affect the nozzle life by becoming deposited in very small quantities in the region of the orifice. While it is quite likely not possible to fully explain this phenomenon at the present time, a hypothesis can be advanced with reasonable justification. This hypothesis entails an examination of theoretical instantaneous temperature and pressure conditions of the water at the surface area adjacent the orifice.

First, it must be recognized that at the exit area very close to the nozzle orifice, the water in a very short period of time (in the order of microseconds) goes from a relatively very low velocity and a very high pressure to an extremely high velocity and much lower pressure. With regard to the layer of water immediately adjacent the nozzle surface at the nozzle exit area, this thin layer of water is subjected to extremely high shear forces which result in heating of the water. For example, with the velocity of the jet exiting from the nozzle being as high as fifteen hundred feet per second, the temperature of the water immediately adjacent the surface at the exit area can be calculated to be as high as 140° F. When the velocity of the jet is as high as three thousand feet per second, this temperature can be calculated to be as high as 400° F. In both cases a linear velocity profile is assumed to exist in the area of the wall.

With regard to the pressures of the water at various locations in the area of the nozzle, it can be presumed that the static pressure of the water in the jet stream itself exiting from the nozzle at full velocity is approximately atmospheric pressure, since the static pressure head has been transformed to dynamic pressure head. At the area where the water separates from the nozzle surface to form the jet stream, it can be further presumed that the pressure in this space between the jet stream and the nozzle wall is substantially less than atmospheric and more nearly a vacuum, since the air of other gas which might exist in this area is drawn from this space by the aspirating action of the very high velocity jet. At the surface area of the nozzle immediately upstream of the location at which separation of the water from the nozzle surface occurs, it can be presumed that there is a liquid water layer of an extremely small thickness immediately adjacent the surface, which layer has substantially zero velocity or at least very low velocity relative to the main flow of water. It can be theorized that there may well be almost instantaneous and substantial pressure increases in the water subjected to these substantial shear forces. It is also possible that due to small variations in the surface of the orifice, there may be very small localized areas where very low pressures might occur, which in turn might cause almost instantaneous vaporization in such areas.

On the basis of the assumptions made above, it is believed that even with a very small amount of solid material dissolved in the water, because of the temperature and quite probably the pressure conditions existing at the nozzle surface area immediately adjacent the nozzle orifice, the material dissolved in the water precipitates from the thin layer of water immediately adjacent the surface at the exit area to become deposited on the surface area at the orifice, this occurring even at the very location where the velocity of the water passing through the jet nozzle is close to velocities as high as three thousand feet per second. When such deposits accumulate on the surface at the exit area, even in amounts as little as a small fraction of a thousandth of an inch, this can cause sufficient disturbance to produce quite noticeable dispersion in the jet stream.

With regard to experimental results to substantiate this theory, relatively pure water, having total dissolved solids in the order of approximately one hundred parts per million was utilized in a pressure intensifying apparatus and discharged through a nozzle of approximately 0.008 inch in diameter. After four hours of operation, there was a noticeable deterioration of the coherency of the water jet. The nozzle was removed and examined with an electron microscope so that the surface immediately adjacent the nozzle orifice was magnified two and a half thousand times. It was ascertained that the surface area immediately adjacent the orifice had an accumulation of very small deposits in the order of one ten thousandths of an inch in thickness. Then the pressure intensifying apparatus was operated again under substantially the same conditions, except that the water was first subjected to a treatment to remove the dissolved solids down to a level of less than ten parts per million. Also, the $CaCO_3$ hardness of the water was reduced from a reading of forty-two ppm (for the untreated water) to a reading of less than one ppm by such removal of dissolved solids. After one hundred hours of operation, there was no substantial deterioration of the coherency of the jet stream. A subsequent examination of the nozzle component by an electron microscope indicated that there was little noticeable deposit of material in the nozzle area adjacent the orifice.

Thus, in the method of the present invention, there is provided a means of providing a high velocity liquid jet, such as a water jet used in cutting material, in a manner to maintain the coherency of the jet over a longer period of life of the discharge nozzle. In this method, there is a first step of removing from the water which is the working liquid, material which tends to precipitate from the water as a solid at a temperature at least as high as 140° F. and desirably up to levels of 400° F. or higher. Then the water is filtered and pressurized to a level of at least fifteen thousand pounds per square inch, and in many instances up to levels of fifty thousand pounds per square inch and higher, (depending upon the velocity of liquid jet required), after which the pressurized water is directed through an orifice of a nozzle to form a high velocity coherent jet of water.

With regard to removing the dissolved material from the water, readily available prior art techniques for accomplishing this have proven to be quite satisfactory. For example, a typical prior art ion exchange process can be utilized to precipitate both the cation and anion constituents, and thus remove sbstantially all the dissolved solids. Also it has been found satisfactory to utilize conventional water softening techniques which are essentially designed to remove such dissolved material as calcium, magnesium, iron and silica. While such water softening techniques commonly precipitate out the metal in the form of insoluble salts and leave a sodium salt still dissolved in the water, such dissolved sodium salts do not readily precipitate at the temperature and pressure conditions existing at the surface of the discharge orifice and thus can be permitted to remain dissolved in the water in the practice of the present invention. Also, with regard to silica, the removal of which is believed to be quite important in the practice of the present invention, an adsorption technique (such as use of pellets of magnesium salts or magnesium oxide) can be utilized.

Within the broader scope of the present invention, other techniques for removing dissolved solids could also be used, such as distilling the water before directing it to be the pressure intensifier. However, in the great majority of instances, for the type of water generally used in pressure intensifying apparatus, there is no particular advantage in using such other techniques which quite often entail certain disadvantages, such as greater expense of materials or equipment, higher energy utilization for the amount of water treated, etc.

Other features of the present invention will become apparent from the following detailed description.

BRIEF DESCRIPTION OF THE DRAWING

FIG. 1 is a side elevational view of a pressure intensifying apparatus by which the present invention can be practiced;

FIG. 2 is a longitudinal sectional view of a discharge nozzle of the apparatus of FIG. 1;

FIG. 3 is a schematic drawing illustrating the steps by which the dissolved material is removed from the working fluid used in the process of the present invention; and FIG. 4 is an enlarged sectional view of the crystal component defining the discharge orifice of the nozzle of FIG. 2.

DESCRIPTION OF THE PREFERRED EMBODIMENTS

It is believed that a better understanding of the present invention will be achieved by preceeding a detailed description thereof with a brief disclosure of a pressure intensifying apparatus by which the present invention can be practiced.

In FIG. 1, there is shown a jet cutting apparatus 10, comprising an electric motor 12, which drives a hydraulic pump 14, which in turn supplies working fluid (i.e. water) to a high pressure intensifier unit 16. The intensifier 16 draws fluid (i.e. water) from a suitable source, such as a reservoir 18, and directs the water at a very high pressure through a conduit 20. At the discharge end of the conduit 20 is a nozzle assembly 22, from which there is discharged a very high velocity, small diameter liquid cutting jet 24.

The forward end of the nozzle assembly 22 is shown more particularly in FIG. 2. It comprises a generally cylindrical elongate housing, the front end of which is shown at 26, and the rear end of this housing 26 is connected by conventional means to the conduit 20. The housing 26 defines a cylindrical chamber 28 to receive the water from the intensifier 16 under very high pressure.

There is a nozzle housing 30 defining a longitudinal through opening 32 and comprising a rear mounting portion 34 and a forwardly extending stem 36 that fits loosely in a forward cap member 38. This cap member 38 threads onto the forward end of the housing 26 to press against the nozzle housing 30 so that a rearwardly tapering conical surface 40 of the nozzle housing 30 bears against a matching surface 42 of the housing 26 to form a seal between the nozzle housing 30 and the housing 26.

At the rear center portion of the nozzle housing 30, there is a cylindrical recess or counter bore 44 in which is mounted a nozzle element 46 in which is formed a nozzle discharge opening or orifice 48. The nozzle element 46 can be of conventional design; typically it has a cylindrical configuration and is made of a durable material, such as corundum. In a typical orifice nozzle, the read edge of the nozzle element 46 that defines the entrance to the nozzle opening 48 is a right angle circular edge that is very slightly rounded to reduce wear. The radius of curvature of the edge 50 in a typical nozzle element 46 would be about 0.0002 inch.

Surrounding the nozzle element 46 and in contact therewith is a mounting ring 51 made of a moderately yielding plastic material. The ring 51 is press fitted into the annular recess formed by the side wall of the cavity 44 and the side wall of the nozzle element 46. When the nozzle assembly 22 is subjected to a very high pressure from the fluid in the chamber 28, the resulting pressure against the rear exposed surface of the nozzle element 46 and the ring 51 causes the mounting ring 51 to press radially inwardly against the nozzle element 46 with substantially uniform pressure, so as to alleviate any tendency for such inward pressure to crack or otherwise damage the nozzle element 46.

In the method of the present invention, the water which is the working fluid is treated to have removed therefrom dissolved material which tends to precipitate from the water at temperatures at 140° F. or above. This treatment can be most conveniently accomplished by processing the water before it is delivered to the reservoir 18, or at least before the water is delivered to the pressure intensifier 16. The steps in this treatment are illustrated schematically in FIG. 3.

Initially, dissolved material is removed from the water, which is then passed through a three-stage filter to remove precipitates and initially undissolved material from the water. In a typical application, the first two stages of the filter would have a pore size of approximately one micron, with the third stage having a pore size of 0.45 micron.

Prior to the filtering of the water, the water is then treated to remove dissolved solids. Since in most instances the water used in the apparatus is drawn from a source in the locality of use, generally the most practical way to practice the present invention is to utilize those techniques which are presently available in that particular locale. Since these particular techniques are generally quite well known in the prior art, these will be described only briefly herein.

One means which has proven quite satisfactory is to use conventional water softening techniques to remove dissolved solids. A typical means is to utilize lime ($Ca(OH)_2$) and soda ash ($Na_2CO_3$) to precipitate calcium, magnesium and iron which are usually dissolved in the water as a bicarbonate, as well as other material. The lime causes such metals to precipitate as a metal carbonate, which is then removed by conventional methods. The soda ash functions in the presence of sulfate and chloride ions to precipitate the metal ion, for example, calcium as a calcium carbonate. The sodium remains dissolved in the water (e.g., as a sodium sulfate, sodium chloride, etc. depending upon the initial dissolved material in the water), but it has generally been found not to be necessary to remove such dissolved sodium salts in the present invention. It is believed that this is due to the fact that such sodium salts do not tend to precipitate at the high instantaneous temperatures and at the pressure conditions existing at the particular surface area of the nozzle orifice where other dissolved material tends to deposit.

In conventional water softening techniques, sometimes magnesium oxide and magnesium hydroxide are added to help coagulate the precipitates. Also, in situations where the quantity of carbonate and non-carbonate is the same, caustic soda can be utilized. This causes the calcium to precipitate as calcium carbonate, and the sodium remains dissolved in the water. Gypsum ($CaSO_4$) is sometimes used if the water has a high $NaHCO_3$ alkalinity. In this case, the calcium again precipitates as calcium carbonate, and the salt remains dissolved as sodium sulfate. Another prior art technique for softening of water is using zeolite. There are natural zeolite minerals which are complex forms of sodium-aluminum silicate. Also, there are synthetic materials, such as sulfonated coal, phenolic resins and polystyrene resins. These compounds comprise a complex molecule with sodium attached and available for reaction so that the undesired minerals are removed from the water.

Various phosphates may be used, and since the technique of using phosphates generally requires that the reaction components be heated, this process is used quite advantageously where silica is to be removed. Typical of such phosphate compounds are the following: monosodium phosphate, anhydrous; monosodium phosphate, monohydrate; disodium phosphate, anhydrous; disodium phosphate, crystalline; trisodium phosphate, monohydrate; trisodium phosphate, crystalline; and phosphoric acid, 75% solution.

For the removal of silica, this is generally carried out in a conventional hot process lime or lime-soda softener. Magnesium oxide is normally used in this process, but the following magnesium salts also have been used: epsom salts ($MgSO_4$); dolomitic lime; calcined magnesite; magnesium carbonate; magnesium oxide. The removal of silica is by adsorption and is governed by temperature and time conditions. For proper removal, the water should be slightly basic.

For substantially complete removal of dissolved solids, an ion exchange technique is utilized where both the cation and anion constituents are removed. Typically, to remove the cation constituents, there is used a zeolite mineral which has been rejuvenated with acid so that the hydrogen radical takes the place of the sodium. To remove the anion constituents, an anion exchange resin is added. There are basically two types of anion exchange resins. There is an aliphatic amine which is weakly basic, and comes generally in a particle size of 16–50 mesh granules (i.a. those granules which pass a screen having 16 mesh to the inch and are retained on a screen having 50 mesh to the inch). The second class is strongly basic, and comprises quaternary amine polystyrene resins containing alkyl groups in the quaternary structure or else quaternary amine polystyrene resin containing both alkyl and alkanol groups in quaternary structure.

It is to be understood, of course, that the above discussion is by no means exhaustive of the techniques which can be used for removal of dissolved solids, and is intended to be only representative of techniques commonly used for fresh water found in many locales in the geographical area of the United States. As a practical guide to practicing the present invention, the more economical way to proceed is to utilize the existing technology which has been found effective in removing dissolved constituents in the particular locality from which the water employed in the present invention is supplied.

As indicated previously, within the broader scope of the present invention, other techniques might also be used, such as distilling the water to remove solids. However, for practical reasons, it is usually more desirable to employ techniques such as those described above.

Subsequent to the treatment of the water to remove dissolved material, the water is directed into the pressure intensifier 16, and discharged through the nozzle assembly 22 to pass therefrom as the jet stream 24. The manner in which the water flows from the chamber 28 through the orifice 48 is illustrated in FIG. 4.

The water in the high pressure chamner 28 is at a level of at least approximately fifteen thousand psi, and more commonly in the range of fifty thousand psi or above. As the water moves through the chamber 28 forwardly and approaches the orifice 48, the flow lines of the water begin to converge toward the orifice 48 and the water approaching the orifice 48 begins to accelerate very rapidly so that as it passes into the orifice 48 as a jet of very small diameter, its velocity has increased to the maximum, and its static pressure has been reduced to substantially atmospheric pressure.

For purposes of comprehending the significance of the present invention, three surface areas of the nozzle element 46 will be considered, namely: (a) the rearwardly facing surface 52 which is immediately upstream of the orifice 48, (b) the cylindrical wall 54 which defines the orifice or discharge opening 48, and (c) the slightly rounded edge or corner surface 50 which defines the entry area at the juncture of the two surfaces 52 and 54.

With regard to the flow of water along the surface 52, as this water approaches the edge 50, it accelerates rapidly and it is near full discharge velocity as it moves past the corner 50. Because of the friction created by the water passing closely adjacent the surface 52 at such high velocities, there are very high shear forces created immediately adjacent the surface 52. The rather substantial amount of energy required to overcome such frictional forces is applied in a very localized area of the water flow immediately adjacent the nozzle surface 52. Calculations can be made which indicate that when the velocity of the water in the jet 24 is fifteen hundred feet per second, with the water initially at 50° F., the instantaneous temperature at the surface 52 at the area of greatest velocity is approximately 140° F., which is a substantially instantaneous increase in temperature of 90° F. When the velocity of the water jet 24 is as high as two thousand feet per second, this temperature is about 210° F.; for a velocity of twenty-five hundred feet per second, this temperature is approximately 300° F.; and for a velocity of three thousand feet per second, the temperature of the water passing closely adjacent the surface 52 at the area of greatest velocity is approximately 410° F.

With regard to the pressure of the water adjacent the wall 52, there are a number of factors to be considered. Simply by applying Bernoulli's law, it can be determined that when the water at substantially zero velocity and very high pressure is moved to its full discharge velocity, the static pressure head is translated into a dynamic pressure head, which reduces the static pressure in the water flowing at full velocity to substantially atmospheric pressure. Thus, it can be presumed that the total mass of water passing through the plane defined by the orifice edge 50 would be at a pressure only a very small fraction of that of the water in the main portion of the pressure chamber 28. However, as indicated previously herein, the water closely adjacent the surface 52 near the orifice edge 50 is subjected to very substantial shear forces. It is also believed that there are substantial pressure gradients in that small portion of the water being subjected to very high shear forces, which in turn could cause sudden and almost instantaneous pressure changes in a water parcel flowing along the surface 52 to the edge of 50.

It is believed that the almost instantaneous temperature and pressure conditions which exist at the surface 52 closely adjacent the orifice edge 50 cooperate to cause precipitation of dissolved material in the water, even when such dissolved material is of such a low magnitude that the water is by all ordinary standards very pure so as to be almost distilled water. There are quite likely other phenomena which affect this condition. For example, even though the nozzle element 46 is within very close tolerances, there are still surface irregularities of very small dimensions which may also have quite localized affect which influence precipitation of dissolved material from the water.

To explain this more fully, as the water moves past the orifice edge 50, it separates from the orifice element wall and forms into the jet 24 which passes by the orifice defining wall 54 without even coming in contact with the wall 54. Just downstream of the area of separation of the water, there is formed a gap between the water jet 24 and the wall 54, which gap or space is indicated at 56. Because of the aspirating effect of the high velocity jet, whatever air or other gas might be in this space 56 is aspirated away so that the pressure in this space 56 is substantially below atmospheric and approaches a near vacuum. It is surmised that there is a localized condition at this area of separation which also tends to precipitate dissolved material from the water and cause deposits at the surface area 50 at the orifice edge. It is believed that quite close to the area of separation, there is a very small area where very localized vaporization or boiling of the water occurs to cause precipitation of any dissolved material, which is deposited on the wall 50. It is also possible that due to small surface irregularities in the surface wall 52 closely adjacent the edge 50, there may be some separation from the water from the surface 52 in very localized areas. This in turn would cause some almost instantaneous and quite localized vaporization, which in turn could be a cause of some precipitation of solids from the water and consequent deposits on the surface 52.

Experimental results thus far give some indication that the removal of silica particularly is critical to the operation of the present invention. In certain experimental runs where the untreated water contained dissolved silica as well as other dissolved minerals, it was noted that the deposits on the nozzle were predominantly silica. It is possible that silica, when it precipitates, has more of a tendency to adhere to an adjacent surface under conditions where the liquid in which the silica precipitates is moving at a very high velocity relative to such surface.

At any rate, regardless of the validity of the above hypotheses, it has been found that by treating water which is considered very pure by ordinary commercial standards to remove even these minute percentages of dissolved material, the operating life of the nozzle element 46 can be substantially increased.

EXAMPLE I

Untreated water was taken from the municipal water system at Kent, County of King, State of Washington, which water by practical standards is considered the near equivalent of ultra pure distilled water. This water was then used as the working fluid in a high pressure fluid intensifier which pressurized the water to fifty thousand psi and discharged this water through a nozzle orifice at a velocity of three thousand feet per second, with the water initially being at a temperature of 50° F. The nozzle element defining the orifice was a corundum crystal having an outside diameter of 0.065 inch, and having a water discharge orifice of 0.008 inch in diameter.

The pressure intensifying apparatus was operated for 4 hours. At intervals of 15 minutes throughout the operation of the apparatus, the character of the jet stream of water being discharged was observed. During the first 3 hours of operation, the stream was quite coherent and had little, if any, dispersion over what is normally considered a high quality jet stream. After 3 hours of operation, some deterioration in the coherency of the jet stream was noticed. After 3.75 hours of operation, the coherency of the jet stream had deteriorated to the extent that it was below the normally accepted operating standards for such streams. These determinations were made by visual observance, which has proved to be quite satisfactory in evaluating quality of jet streams.

Then the water was treated as follows. A flow of water of 0.7 gallons per minute was directed through a 9 Inch Mixed Bed Deionizer SB Anion Type 2, made by the Culligan Water Service Corporation, No. 1 Culligan Parkway, Northbrook, Ill. This is a quite conventional deionizer available in many parts of the United States.

The specification of such water before and after treatment is as follows:

| Dissolved Component | Rw Water (ppm) | Water after treatment (ppm) |
|---|---|---|
| $S_1O_2$ | 17 | .06 |
| Ca | 11 | less than .4 |
| Mg | 3 | less than .2 |
| Na+K | 7 | less than .1 |
| $HCO_3$ | 49 | less than .2 |
| Chloride | 2 | less than .6 |
| Sulphate | 11 | less than 1 |
| Nitrate | 7 | less than 1 |
| Total dissolved solid | 103 | less than 10 |
| $CaCO_3$ hardness | 42 | less than 1 |

The water which flowed from the treatment apparatus was then directed into the same pressure intensifying apparatus described above, pressurized to fifty thousand psi and discharged as a jet stream at a velocity of about three thousand feet per second. A nozzle element the same as that described above was used. After initial start up of the apparatus, the jet stream was quite coherent. The apparatus was operated for approximately 84 hours, and there was no substantial deterioration in the quality of the jet stream. The nozzle element was removed, and was compared with the first nozzle element by means of an electron microscope which magnified two and a half thousand times. The nozzle element that was used with the untreated water showed very small deposits thereon (in the order of 0.0002 inch in thickness), with the highest concentration of deposits being at the edge which defined the entrance to the orifice and at the surface immediately surrounding such edge (this surface being designated 52 in the description given previously herein). The nozzle used after treatment to remove the dissolved solids showed negligible deposits in the above mentioned areas.

What is claimed is:

1. A method of providing a high velocity liquid jet, such as a water jet, said method comprising:

(a) removing from the liquid dissolved material which tends to precipitate as a solid at a temperature at least as high as 140° F., (b) pressurizing said liquid to at least fifteen thousand pounds per square inch, and (c) directing said pressurized liquid through an orifice of a nozzle to form a high velocity coherent liquid jet, with said liquid passing through the orifice of the nozzle, without causing appreciable material deposits on the nozzle at the location of the orifice.

2. The method as recited in claim 1, further comprising removing from the liquid dissolved material which tends to precipitate as a solid at a temperature at least as high as 210° F.

3. The method as recited in claim 1, further comprising removing from the liquid dissolved material which tends to precipitate as a solid at a temperature at least as high as 300° F.

4. The method as recited in claim 1, further comprising removing from the liquid dissolved material which tends to precipitate as a solid at a temperature at least as high as 400° F.

5. The method as recited in claim 1, wherein said liquid is water and the dissolved material is removed from the water by subjecting said water to a water softening treatment.

6. The method as recited in claim 1, wherein said liquid is water, and the dissolved material is removed from said water by deionizing where both cation and anion constituents are removed from the water.

7. The method as recited in claim 1, wherein said liquid is water and dissolved silica is removed from said water.

8. In a method of providing a high velocity liquid jet, such as a water jet, wherein the liquid is pressurized to a very high pressure level and directed through an orifice of a nozzle to form a high velocity coherent liquid jet, the improvement comprising:

initially removing from the liquid dissolved material which tends to precipitate as a solid at the orifice surface under conditions where said liquid is passing through the orifice of the nozzle at a velocity of at least approximately fifteen hundred feet per second.

9. The improvement as recited in claim 8, comprising initially removing from the liquid dissolved material which tends to precipitate as a solid at the orifice surface under conditions where the liquid passes through the orifice of the nozzle at a velocity of at least two thousand feet per second.

10. The improvement as recited in claim 8, comprising initially removing from the liquid dissolved material which tends to precipitate as a solid at the orifice surface under conditions where the liquid passes through the orifice of a nozzle at a velocity of at least twenty-five hundred feet per second.

11. The improvement as recited in claim 8, comprising initially removing from the liquid dissolved material which tends to precipitate as a solid at the orifice surface under conditions where the liquid passes through the orifice of a nozzle at a velocity of at least three thousand feet per second.

12. The improvement as recited in claim 8, wherein said liquid is water and the dissolved material is removed from the water by subjecting said water to a water softening treatment.

13. The improvement as recited in claim 8, wherein said liquid is water, and the dissolved material is removed from said water by deionization where both cation and anion constituents are removed from the water.

14. The improvement as recited in claim 8, wherein said liquid is water and dissolved silica is removed from said water.

15. A method of providing a high velocity water jet, said method comprising:

(a) initially drawing water from a source where the water contains dissolved material.

(b) removing dissolved material from the water.

(c) pressurizing the water to at least fifteen thousand pounds per square inch.

(d) directing said pressurized water through an orifice of a nozzle to form a high velocity coherent water jet, with said water passing through the orifice of the nozzle without causing appreciable material deposits on the nozzle at the location of the orifice.

16. The method as recited in claim 15, further comprising removing from the water dissolved material which tends to precipitate as a solid at a temperature at least as high as 210° F.

17. The method as recited in claim 15, further comprising removing from the water dissolved material which tends to precipitate as a solid at a temperature at least as high as 300° F.

18. The method as recited in claim 15, further comprising removing from the liquid dissolved material which tends to precipitate as a solid at a temperature at least as high as 400° F.

19. The method as recited in claim 15, wherein the dissolved material is removed from the water by subjecting said water to a water softening treatment.

20. The method as recited in claim 15, wherein the dissolved material is removed from said water by deionizing where both cation and anion constituents are removed from the water.

21. The method as recited in claim 15, wherein dissolved silica is removed from said water.

22. The method as recited in claim 15, comprising removing from the water dissolved material which tends to precipitate as a solid at the orifice surface under conditions where said water is passing through the orifice of the nozzle at a velocity of at least approximately fifteen hundred feet per second.

23. The method as recited in claim 15, comprising removing from the water dissolved material which tends to precipitate as a solid at the orifice surface under conditions where the water passes through the orifice of the nozzle at a velocity of at least two thousand feet per second.

24. The method as recited in claim 15, comprising initially removing from the water dissolved material which tends to precipitate as a solid at the orifice surface under conditions where the water passes through the orifice of a nozzle at a velocity of at least twenty-five hundred feet per second.

25. The method as recited in claim 15, comprising initially removing from the water dissolved material which tends to precipitate as a solid at the orifice surface under conditions where the water passes through the orifice of a nozzle at a velicity of three thousand feet per second.

* * * * *